US005387437A

United States Patent [19]

Yao

[11] Patent Number: 5,387,437

[45] Date of Patent: Feb. 7, 1995

[54] PEELING STRENGTH ON BREATHABLE COATING FABRICS

[75] Inventor: Shin-Chuan Yao, Taipei, Taiwan, Prov. of China

[73] Assignee: China Textile T&R Institute, Taipei, Taiwan, Prov. of China

[21] Appl. No.: 157,272

[22] Filed: Nov. 26, 1993

[51] Int. Cl.[6] ..... B05D 3/02; B05D 5/00

[52] U.S. Cl. ..... 427/245; 427/246; 427/342; 427/354; 427/389.9

[58] Field of Search ..... 427/244, 245, 246, 342, 427/354, 389.9

[56] References Cited

U.S. PATENT DOCUMENTS

| | | | |
|---|---|---|---|
| 3,664,979 | 5/1972 | Tanomura et al. | 427/246 X |
| 3,666,542 | 5/1972 | Kigane et al. | 427/246 |
| 4,006,052 | 2/1977 | Wang | 427/246 X |

*Primary Examiner*—Michael Lusignan

*Attorney, Agent, or Firm*—Morton J. Rosenberg; David I. Klein

[57] ABSTRACT

A method to improve bonding of breathable coatings onto fabrics uses a hydrophobic polyurethane resin solution having isocyanates and/or double bond polar group crosslinking agents. The substrates used for coating are nylon and polyester taffeta.

2 Claims, No Drawings

PEELING STRENGTH ON BREATHABLE COATING FABRICS

BACKGROUND OF THE INVENTION

In prior art systems, breathable coatings are used mostly on synthetic leathers. Since these synthetics are made of short-fiber fabrics, being thick and of low density, the peeling of the coatings from the fabrics present no problems. When the fabrics chosen for coating are nylon or polyester taffeta, it is difficult to get the breathable coating to adhere because these fabrics are smooth and bonding is difficult. In order to improve the bonding of breathable coatings on these fabrics, we use double bond polar group compounds in the reaction.

SUMMARY OF THE INVENTION

It is an object of the present invention to mitigate and/or obviate the above-mentioned drawbacks of prior art controllers in the manner set forth in the description of the preferred embodiment.

A primary object of the present invention is to provide an improved method of applying breathable coatings onto fabrics. The process uses a low-reactive crosslinking agent of aliphatic diisocyanates and/or double bond polar group compounds added with polyurethane coating solutions and proceeds in warm water below sixty degrees celcius to obtain an improvement in the coating/substrate bonding.

Further objects and advantages of the present invention will become apparent as the following description proceeds, and the features and novelty are characterized in the Claims annexed to and forming a part of this invention.

DESCRIPTION OF THE PREFERRED EMBODIMENTS

According to the present invention, a method for improving bonding of breathable coatings onto fabrics is provided. It uses a low-reactive crosslinking agent of aliphatic diisocyanates and/or double bond polar group compounds added with a polyurethane coating solution. The polyurethane solution includes known polyurethane resins having polyol, diisocyanates, chain extenders, and crosslinking agents. The composition of the polyol can be polyester polyol, polyether polyol, polycaprolactone polyol, polycarbonate polyol, and other double bond polyols. The chain extender can be dioxide or diamine. The crosslinking agent can be any aliphatic isocyanates including diisocyanates and acrylic compounds with an OH-bond.

The proceeding steps of the present invention is stated as follows:

(1) Using a trilobal nylon taffeta to be coated, the substrate is treated with designing, scouring, dyeing, preset, and then calendaring it, followed by adding repellent and a drying treatment to a pick-up rate of 40%.

(2) Preparing a coating solution which includes:

| | |
|---|---|
| polyester polyurethane resin | 100 g |
| anionic surfacant | 3 g |
| nonionic surfactant | 3 g |
| improved crosslinking agent | 5 g |
| paste ($TiO_2$) | 10 g |

(3) Applying the solution to the substrate at the rate of 250 g/m.

(4) Coagulating in a coagulation bath at 40 degrees celcius for 10 minutes.

(5) Hot wash for 10 minutes at temperatures between 70–80 degrees celcius.

(6) Drying and setting.

Comparison of the qualities of the product made by this invention with that by the prior known skill is made in Table I.

TABLE I

| Quality | Breathable degree (g/m /pay) | Sustainable hydraulic pressure (mmHO) | Peeling strength (g/cm) | Repelling (%) |
|---|---|---|---|---|
| embodiment | 4600 | above 1900 | 250–300 | 100 |
| comparison | 4350 | 1700 | 80–100 | 100 |
| Remark | Lyssy RH:90% Temp:4O° C. | AATCC 127 Hydrostatic pressure | ASTM-2724-87 | AATCC 22-1985 |

From Table I, we find an improvement in each quality when the product obtained by the present invention is compared to that used as a reference.

I claim:

1. A method to improve the peeling strength of breathable coated fabrics including the steps of:

(a) establishing a trilobal nylon taffeta substrate to be coated by applying pretreatment steps of designing, presetting, calendaring; and adding repellent and drying treatment to a pick-up rate of 40%, (b) preparing a coating solution which includes:

| | |
|---|---|
| polyester polyurethane resin | 100 g |
| anion surfactant | 3 g |
| nonionic surfactant | 3 g |
| improved crosslinking agent | 5 g |
| paste ($TiO_2$) | 10 g |

(c) applying the coating solution to the substrate at the rate of 250 g/m, (d) coagulating in a coagulation bath at 40 degrees Celsius for a period of time approximating 10 minutes, (e) hot washing for 10 minutes between 70–80 degrees Celsius, and (f) drying and setting.

2. The method as in claim 1, wherein the coating solution consists essentially of repellent, polyester polyurethane resin having an OH-bond or double bond polar group compond and an aliphatic isocyanate is added to the solution to act as the crosslinking agent.

* * * * *